US006411210B1

(12) United States Patent
Sower et al.

(10) Patent No.: US 6,411,210 B1
(45) Date of Patent: Jun. 25, 2002

(54) LASER LIGHTING ASSEMBLY MOUNTED ON A FORKLIFT

(76) Inventors: Forrest D. Sower, P.O. Box 2012 #5, Gig Harbor, WA (US) 98335; Donald A. Moser, P.O. Box 2748, 500 Renne St., Eugene, OR (US) 97402-0280

( * ) Notice: Subject to any disclaimer, the term of this patent is extended or adjusted under 35 U.S.C. 154(b) by 54 days.

(21) Appl. No.: 09/718,184

(22) Filed: Nov. 20, 2000

(51) Int. Cl.[7] ..... G08B 13/18

(52) U.S. Cl. ..... 340/557; 340/555; 340/686.2; 250/491.1

(58) Field of Search ..... 340/557, 555, 340/556, 903, 686.2, 686.6; 180/167; 250/491.1; 356/152.2, 138

(56) References Cited

U.S. PATENT DOCUMENTS 4,678,329 A * 7/1987 Lukowski ..... 356/152
4,684,247 A * 8/1987 Hammill ..... 356/152
6,150,938 A * 11/2000 Sower et al. ..... 340/557

* cited by examiner

*Primary Examiner*—Ahn V La
(74) *Attorney, Agent, or Firm*—Roy E. Mattern, Jr.

(57) ABSTRACT

A laser lighting assembly, mounted on a forklift, will be projecting a light beam parallel to and in the same plane as a fork, which itself is parallel to a floor or ground level. Until the forks are parallel to the floor or ground level the laser light will not be continuously on. When an operator of the forklift is adjusting the forks to be level, and then parallel to the floor or ground level, as the level positions are being approached, the laser light appears in a blinking sequence with the off periods initially being longer and then becoming shorter as the level positions are approached. Then when the level positions of the forks are reached the laser light is on full time. In addition, a laser light beam is provided which projects as a planar beam of light to match the planar location of both of the projecting forks of the forklift, and the operator then, if necessary, adjusts his or her controls of the forklift to insure the forks will also be in the same planar location of the fork receiving volume of the loaded pallet while remaining parallel to the floor or ground level.

25 Claims, 10 Drawing Sheets

LASER LIGHTING ASSEMBLY MOUNTED ON A FORKLIFT

CROSS REFERENCE

This application is a cross reference to, and incorporates the information set forth in the application Ser. No. 09/151,479, filed by Forrest D. Sower and Matthew Scott Sower, on Sep. 9, 1998, and entitled, LASER LIGHTING ASSEMBLY MOUNTED ON A FORKLIFT.

BACKGROUND

The laser lighting assembly mounted on a forklift to project a light beam parallel to and in the same plane as a fork, which is used to accurately direct the fork into a fork receiving volume of a pallet, as illustrated and described in U.S. patent application Ser. No. 09/151,479, is successfully being used to avoid fork damage to a load supported on a pallet. During these period of such successful use, some of those persons who operate the forklift, supervise such operations, and/or have the responsibility over the overall businesses involved, have suggested new requirements they would like to have considered, to improve the advantages to be gained by mounting and operating the laser lighting assembly on a forklift.

SUMMARY

To meet suggestions, requests, and/or demands, improvements to the laser lighting of assembly, in conjunction with other components and related circuitry, are now provided to increase the overall controls and effectiveness of utilizing a laser lighting assembly mounted on a forklift, as shown in the drawings and described in the specification of this application, in comparison with the disclosure in the previous application Ser. No. 09/151,479.

An eye flash from the laser used, known as a class III A Laser, is understood not to be a possible cause of a person's eye damage. Yet to eliminate this perception of such a possible injury, and/or to avoid a nearby worker being startled by a laser flash, possibly causing him or her to have an accident,ran improvement is provided, whereby the laser lighting assembly is automatically controlled only to be on, when a selected pallet fork receiving volume is located at least a given height above floor or ground level.

Currently, the selected height is seven feet, and the selected way of providing this improvement, utilizes infrared waves emitting and receiving equipment mounted at different locales on the forklift. The emitter is adjusted to be effective in a volume above seven feet. Therefore, until the receiver reaches the seven foot level, the laser lighting assembly, via circuitry configurations, will be inactive until the receiver arrives at the seven foot level. Then the receiver becomes active at this level and higher levels served by operating a designated forklit, and the laser lighting assembly is tuned on.

Where these possible concerns are not thought to be necessary at anytime this improvement may not be wanted, and the laser lighting assembly will be on at all levels.

However, when a forklift is to be operated, where these concerns are important most of the time, yet, with precautions, the observance of the reflected laser light beam must be observed at lower levels by an operator, then an overriding control is provided to turn on the laser lighting assembly when operations are undertaken below the selected foot level, which generally is the seven foot level.

In respect to the best positioning of the forks, beyond the correct level of the tips of the forks, there is the need to horizontally position the entire length of each one of the forks. Therefore an another added component, and it's circuitry are utilized to control the on time of the laser lighting assembly, so a laser light beam will only be created and be observable by the operator, when the entire lengths of both forks are horizontal, and parallel to a floor or a ground level. Until the forks are parallel to a floor or a ground level the laser light will not be continuously on. When an operator of the forklift is adjusting to a floor or ground level, and then parallel to a floor or ground level, as the level positions are being approached, the laser light appears in a blinking sequence with the off periods initially being longer and then becoming shorter as the level positions are approached. Then when the level positions of the forks are reached the laser light is on full time.

Yet still at this adjustment period, each fork, although being horizontal, may not be in the same horizontal plane with the other fork. Therefore to further assist the operator of a forklift so he or she may be very sure that the forks will correctly enter the fork receiving volume of a pallet, a laser lighting assembly is designed to project a planar beam of laser light, which appears, when reflected, as a line beam of laser light. This planar beam is of a sufficient line length to let the operator know when he or she has, as necessary, further adjusted the level of the forks tips of the level forks, so they are both in the same horizontal plane. Then when this horizontally. lined beam of laser light disappears at the fork receiving volume of the pallet, the operator of the forklift is further assured, the forks, which are horizontally level and in the same horizontal plane, will perfectly enter the forks receiving volume of the pallet, and no product or products loaded on the pallet will be damaged by the forward movement of the forklift to place the forks into their lifting positions in the fork receiving volume of a pallet.

At all times, the operator of a forklift may turn a master on-off switch to the selected position Then, in addition, timing apparatus and circuitry is provided, so when the master switch has been left on, but the forklift has not been maneuvered during a preset time, the laser lighting assembly will be automatically shut off, and battery energy will be preserved.

DRAWINGS

The improved laser lighting assembly mounted on a forklift to project a light beam parallel to and in the same plane as a fork, and utilized to accurately direct forks into a receiving volume of a pallet, thereby avoiding any fork damage to a load on a pallet is illustrated in the drawings, wherein:

FIG. 1 is a perspective view of a forklift approaching a column arrangement of loads arranged on respective pallets, indicating at this lower level of the forks, the light beam is not being created, to avoid startling person walking nearby, and to avoid any of their concerns about their unintentional viewing of the strong light beam, such as a laser light beam;

FIG. 2 is perspective view, like FIG. 1, of a forklift approaching a column arrangement of a forklift loads arranged on respective pallets, and the forks have been raised sufficiently high that the reflections of the light beam on the loads are observable to the operator, yet when the light beam reaches the fork receiving volume of a pallet, the reflection disappears, indicating to an operator that the forks are at the correct level to be advanced into the fork receiving volume, and thereby avoiding any possible damage to the load, FIG. 3 is a schematic side view, with some portions removed, of a forklift approaching a column arrangement of loads arranged on respective pallets and the phantom lines indicate the forks at respective raised positions, and at the lower position the light beam has not been created to avoid having a person walking nearby being startled or concerned about viewing a strong light beam, such as a laser light beam, and at the higher position the light beam is active and creating a reflection on a load of observation by the operator, and this light beam has been activated when an infra-red generator/emitter's infra-red ray energy emitted from a high frame level location on the forklift is being received by an infra-red receiving module which is on raised vertical portions of a forklift that support the forks of the forklift, and through such transmission and receiving of infra-red wave energy, a switch is automatically turned on, until the infrared wave energy is no longer receivable at lower 8 elevations of the infra-red receiving module being lowered, when the forks are being lowered;

Figure 8:
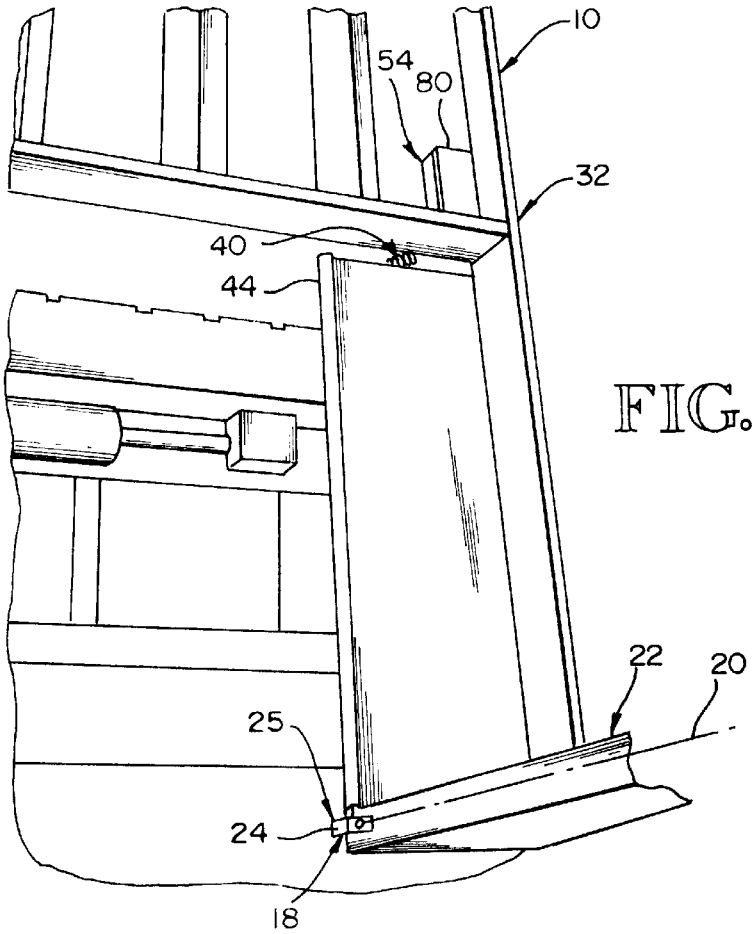
Figure 9:
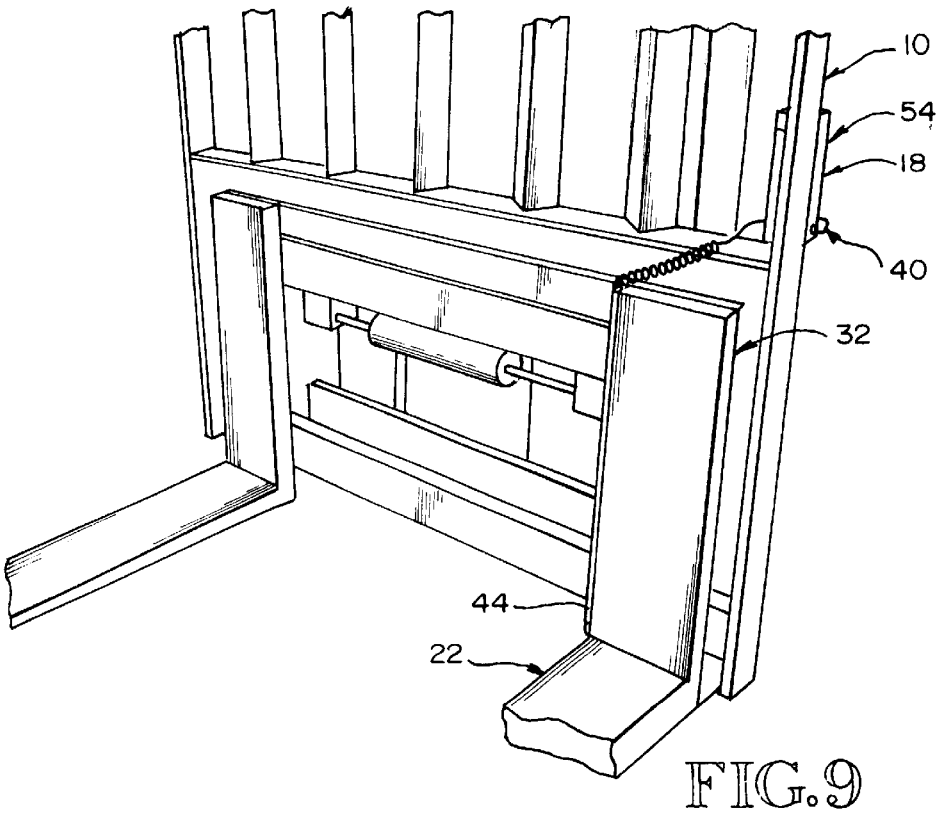
Figure 10:
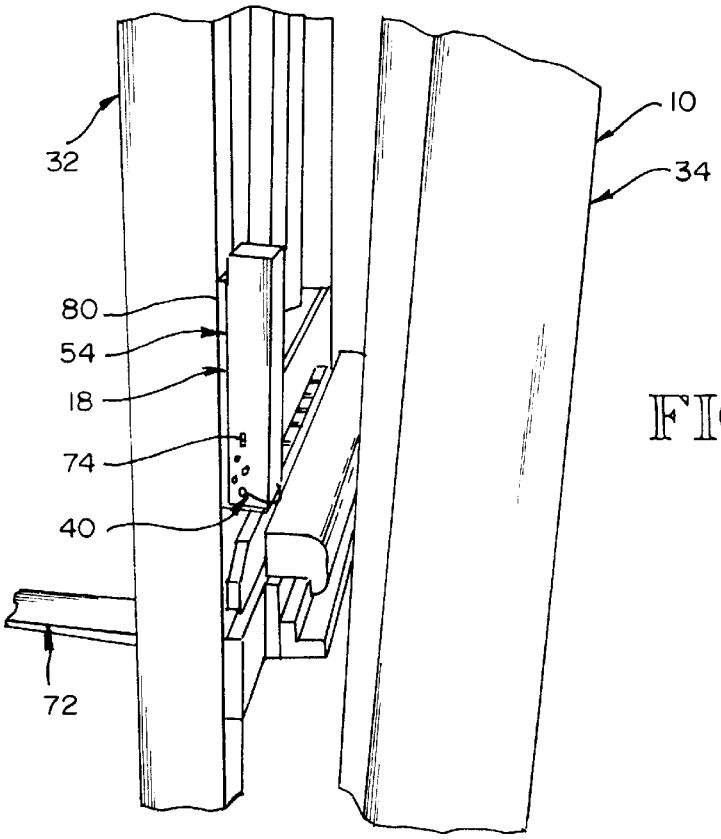
Figure 11:
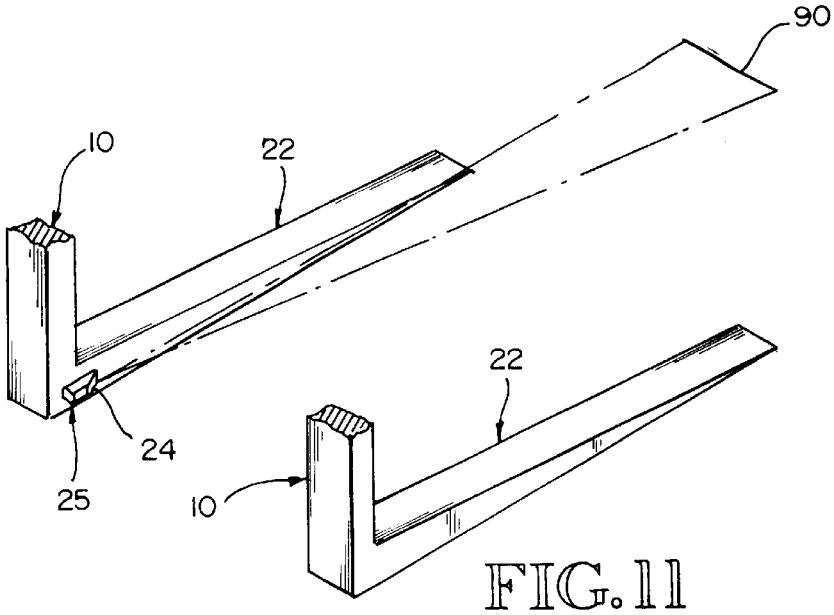
Figure 12:
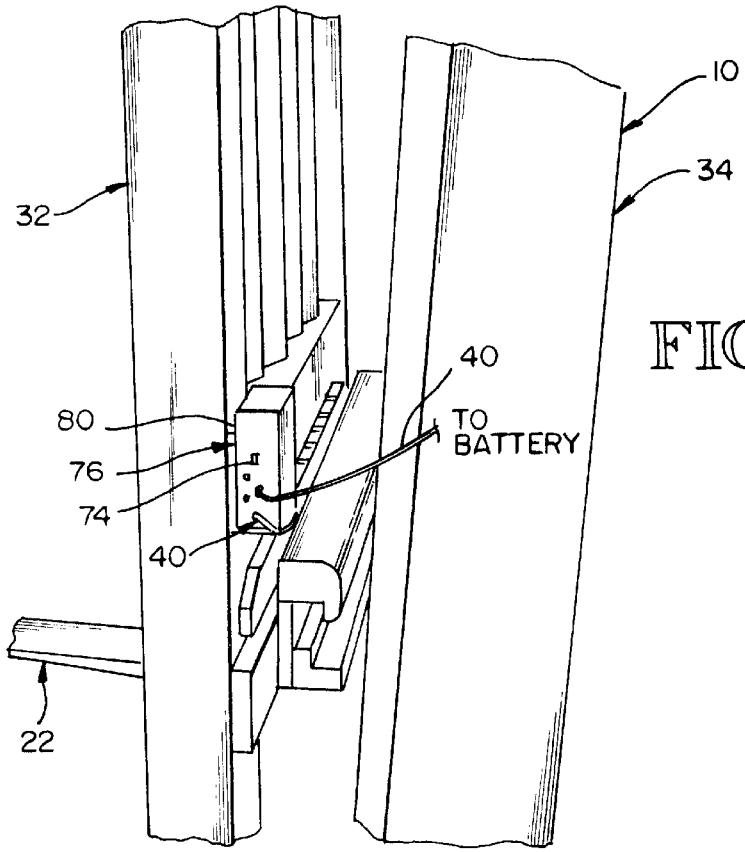
Figure 13:
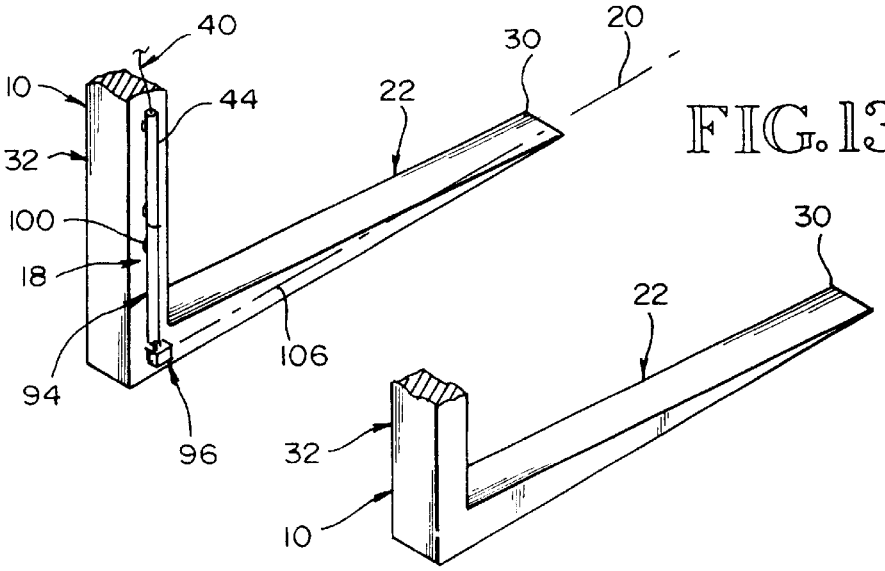
Figure 14:
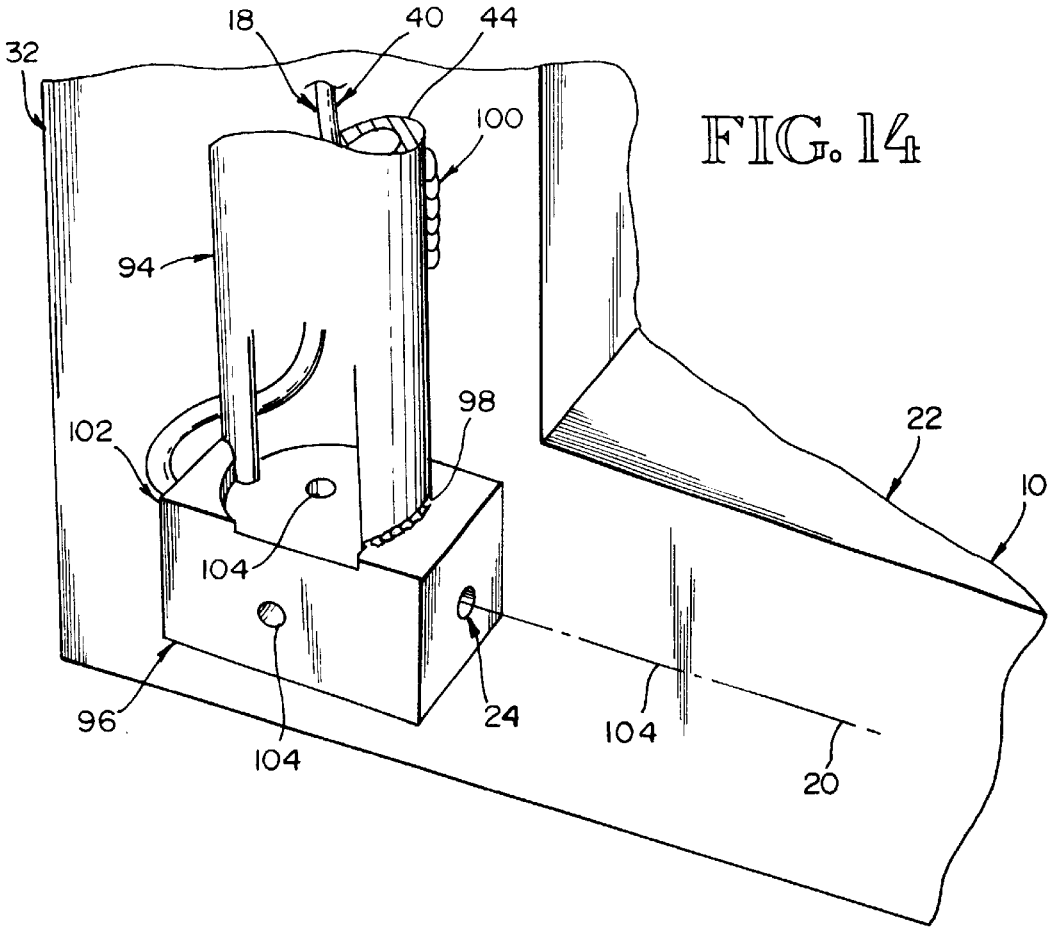
Figure 15:
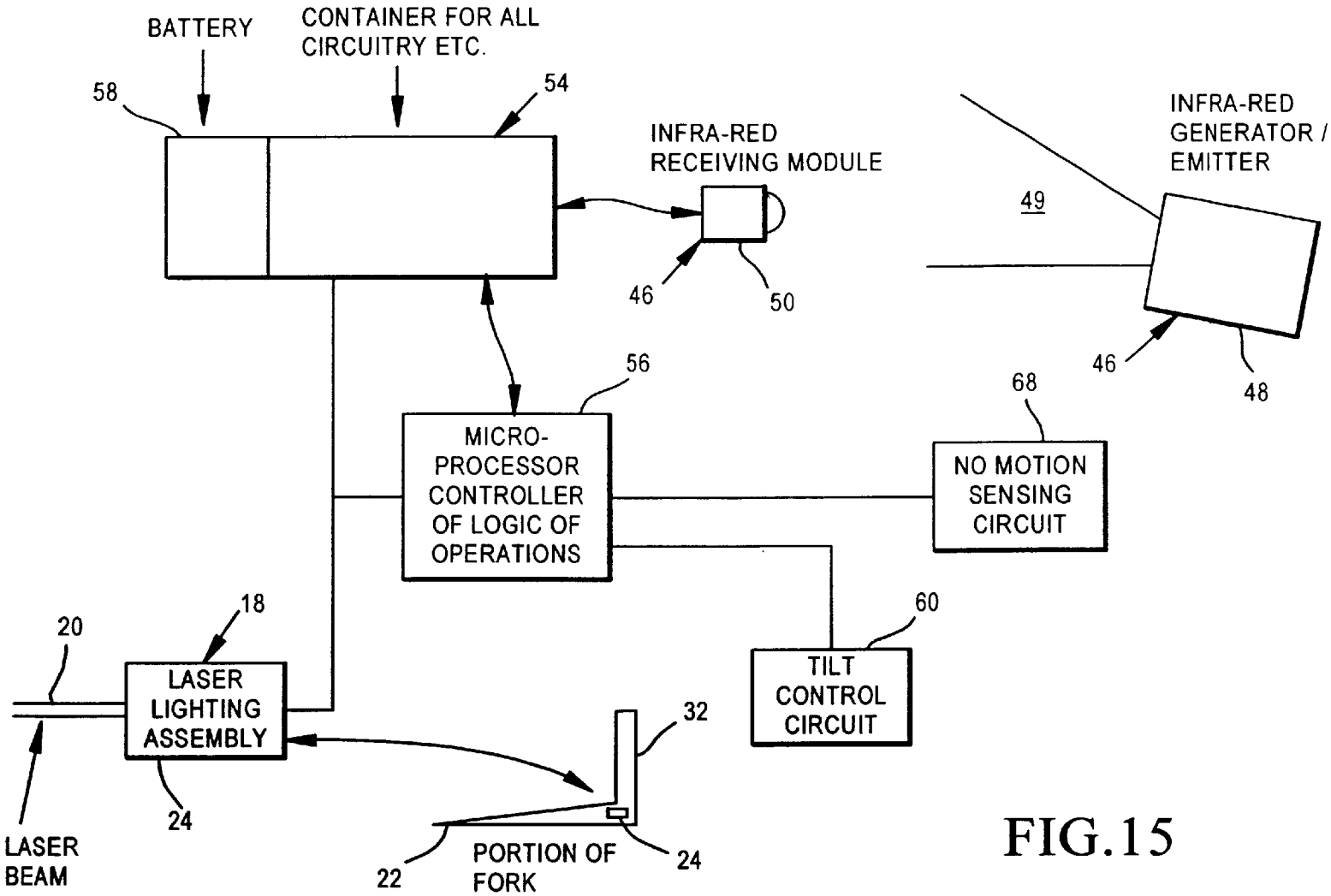
Figure 16A:
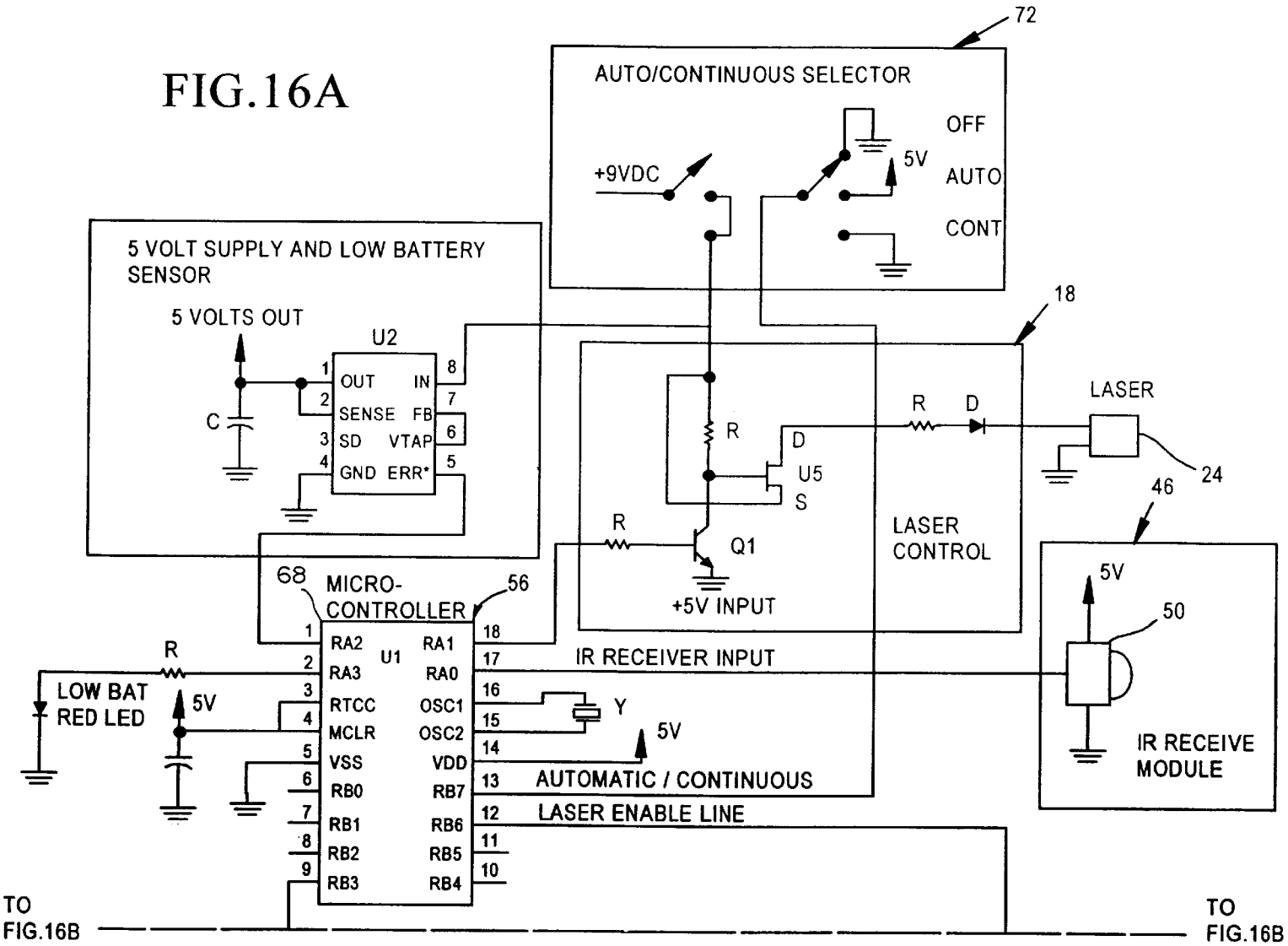
Figure 16B:
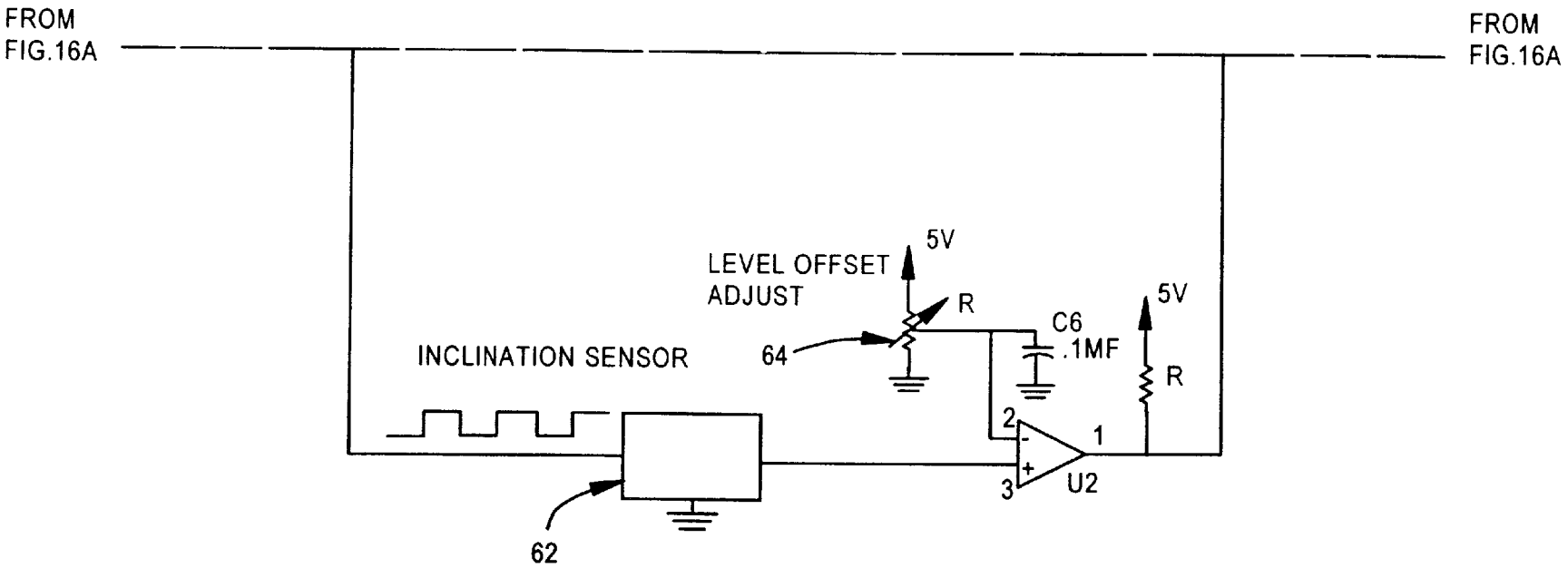

FIG. 8 is a partial perspective lower corner view, of a forklift again showing a selected protective location of the second housing, and then showing the reasonably protective location of the first housing containing the light beam, i.e. laser light beam, creating unit, on an inside side location of the horizontal fork at the location of the base of the upright, i.e. vertical, portion of a forklift, and also showing the expandable length of the circuit wires extending between the first and second housing locations, and portions of these circuit wires are protected within a conduit which is secured to the upright, i.e. vertical portion of the forklift that supports a fork of the forklift;

FIG. 9 is a partial perspective lower front view of a forklift again showing a selective protective location of the second housing, the expandable length of the circuit wires extending between the first and second housing locations, and portions of these circuit wires are protected within a conduit which is secured to the upright, i.e. vertical, portion of forklift that supports a fork of the forklift;

FIG. 10 is a partial perspective side view of the upright, i.e. vertical, portions of a forklift, which also serve in positioning the load while supporting the forks, and showing the selected protective mounting of the second housing, which when moving up and down with these fork structures, moves through the clearance volume between vertical moving and vertical non-moving portions of a forklift;

FIG. 11 is a partial perspective view of the spaced forks of the forklift illustrating the reasonably protective location of the first housing, and showing how a laser light creating unit has been installed in the first housing which produces a planar expanding laser light beam, which upon reaching a load presents a horizontal line reflection for observation of an operator, providing both forks are extending horizontally and both forks are in the same horizontal plane, but if the line reflection is not horizontal, the operator must adjust the positions of the forks until the line reflection is horizontal;

FIG. 12 is similar to FIG. 10, and is a partial perspective side view of the upright, i.e. vertical, portions of a forklift which also serve in positioning the load while supporting the forks, and in this view, a third housing is protectively mounted, and as shown the third housing is smaller than the second housing showing in FIG. 10, because the electrical energy source being utilized is the main large battery installed on the forklift, as indicated by the portions of the circuit wires and the note saying to battery, whereas in contrast the second housing is larger to provide for a battery specifically used to provide the source of electrical energy to the laser lighting assembly operating the laser light unit;

FIG. 13 is similar to FIG. 11, and is a partial perspective view of the spaced forks of the forklift illustrating how a pre-assembly of a smaller fourth housing, a smaller laser lighting assembly, and a first section of the protective conduit, is pre-positioned by clamps, not shown, and then secured to the upright, i.e. vertical, portion of a fork, preferably by welding;

FIG. 14 is an enlarged partial perspective view of portions of the fork and its upright, i.e. vertical, portions showing the. installation of the smaller fourth housing containing the laser light creating unit, and the fourth housing has three access holes for making light alignment adjustments of the laser light creating unit, and also showing how the fourth housing is pre-assembled with the first section of the protective conduit encompassing the circuitry, and how this pre-assembly has been welded to the upright portion of the fork, as previously indicated in FIG. 13;

FIG. 15 is a schematic diagram with names, lines, and arrows to illustrate how the components of the laser light assembly interact with one another; and FIGS. 16A and 16B together illustrate schematically, circuitry and connected components to further indicate how the components of the laser light assembly interact with one another.

DESCRIPTION OF THE PREFERRED EMBODIMENTS

Introduction

Previously in U.S. patent application Ser. No. 09/151,479, a laser lighting assembly 18 was illustrated and described mounted on a forklift 10 to project a laser light beam 20 parallel to and in the same plane as a fork 22, and utilized by an operator of a forklift 10 so he or she could thereafter accurately direct the forks 22 into a fork receiving volume of a pallet 28 thereby avoiding any fork damage to a load 14, often arranged with other loads 14 on pallets 28 in a column 12. The laser light beam 20 reflected on a load 14 as a reflective spot 26, but disappeared when the laser light beam 20 was directed into the fork receiving volume 28 of a pallet 16, thereby indicating to the operator that he or she had the fork 22, on which the laser lighting assembly 18 was mounted, positioned at the proper level to be moved forward into the fork receiving volume 28 of the pallet 10, during the forward movement of the forklift 10.

This first use period of this laser lighting assembly 18 has been very satisfactory accomplished and has been well received. During this first use period, customers, users, and potential customers, offered suggestions which have resulted in the improvements illustrated and described in this application.

The Laser Light Creating Unit is Automatically Only Turned on when the Forks of a Forklift have Reached and Gone Above a PreSelected Level In many areas where forklifts 10 are operated other persons are often walking. Therefore, so they will not be startled by a laser light beam 20 nor concerned with directly viewing a laser light beam 20, an infra-red wave energy system 46 is included, as illustrated in FIGS. 1, 2, 3, 5, 6, 7, 15, and 16A, to automatically only turn on the laser light creating unit 24, when the forks 22 reach a pre-set level above a floor or ground level.

Figure 3:
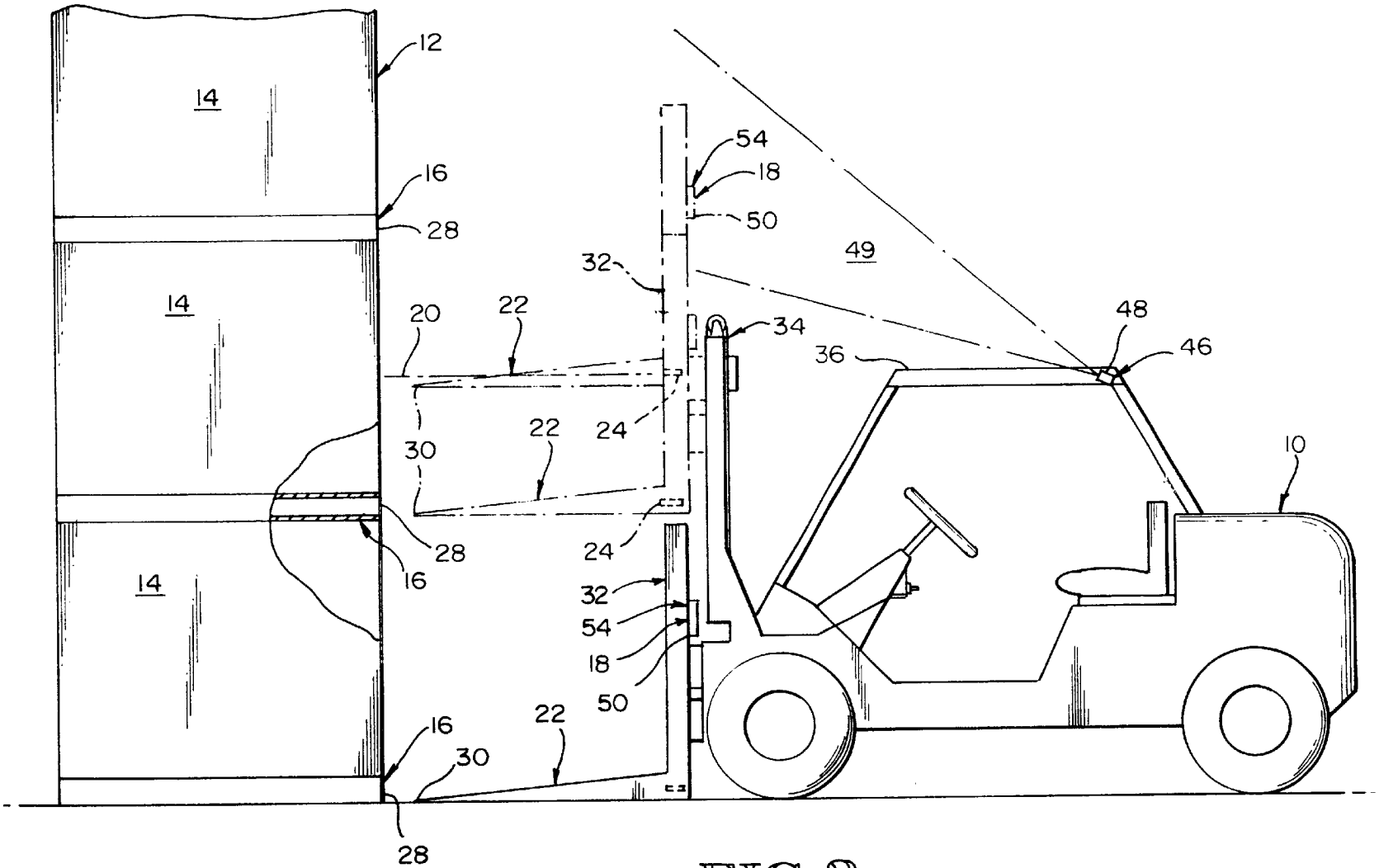
Figure 5:
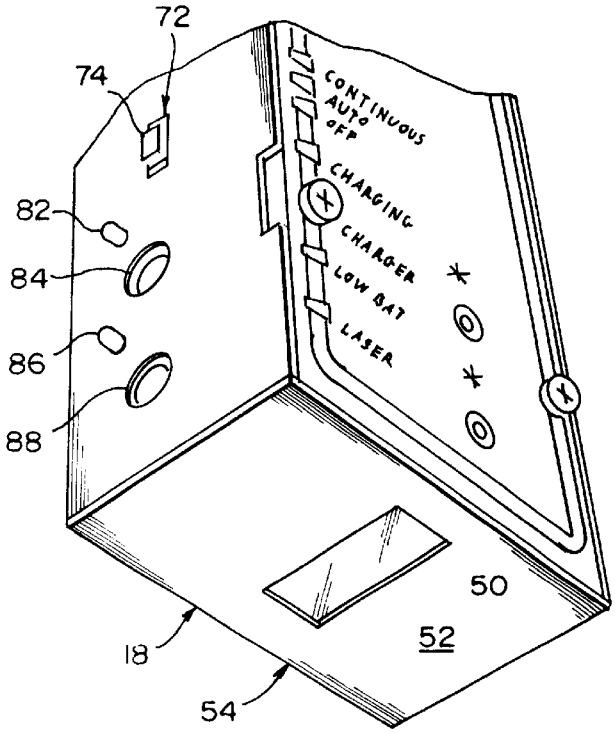
FIG. 5 is a partial perspective view looking up to the second housing to observe where the infra-red receiving module receives the infra-red energy, to observe side location of portions of switch to be manipulated, to observe indicating lights, and to observe circuit connector receiving locations.
Figure 6:
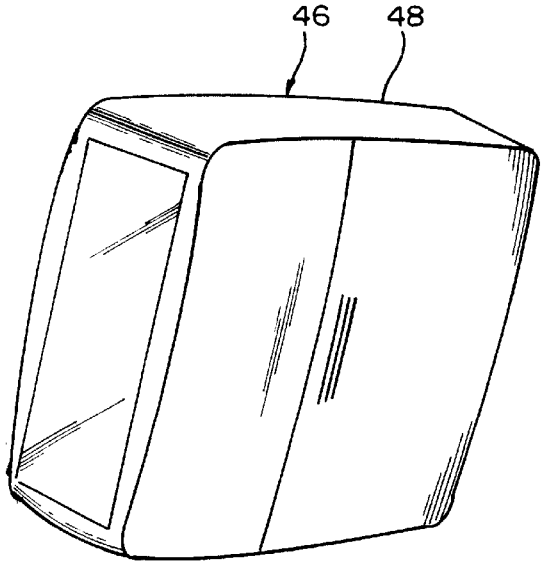
FIG. 6 is a perspective view of the infra-red generator/emitter.
Figure 7:
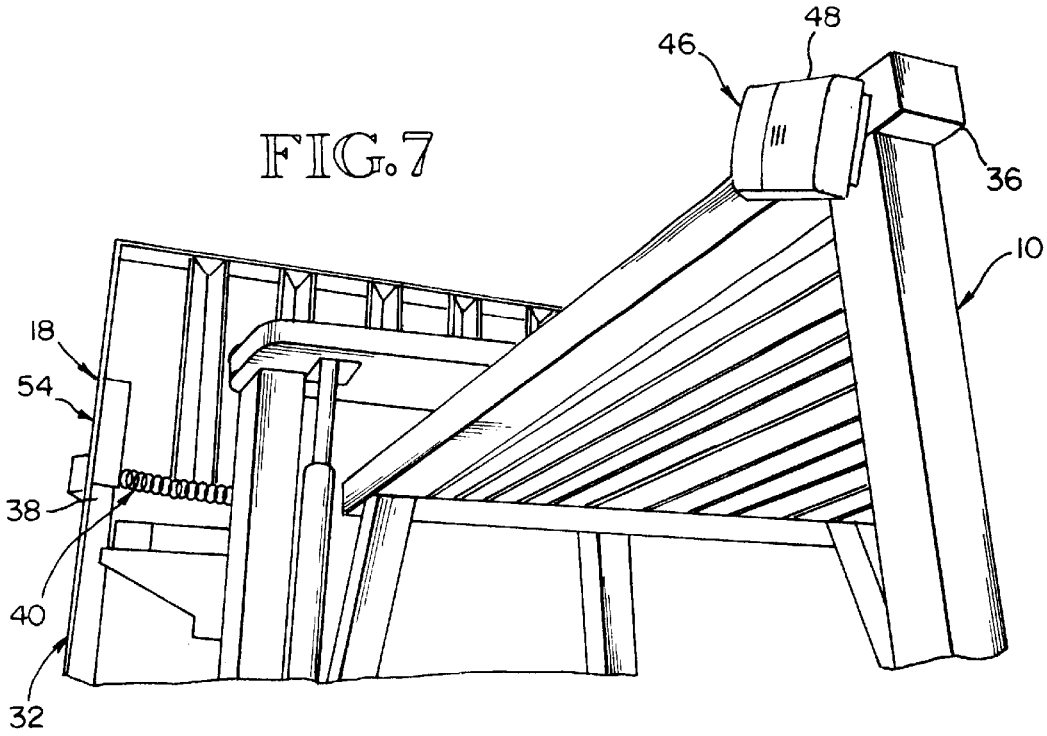
FIG. 7 is a partial perspective view showing a selected protective location on a forklift where the second housing is secured on the backside of the upright, i.e. vertical, portions of a forklift that support the forks of the forklift.

In FIGS. 3, 6, and 7, an infra-red generator/emitter 48 of the infra-red wave energy system 46, is illustrated as it is by itself, also where it is mounted on an overhead high frame portion 36 of a forklift 10, and by using phantom lines, where its effective infra-red wave energy volume 49 is. In FIG. 5, the location of the infra-red wave receiving module 50 of the infra-red wave energy system 46 is shown at the bottom 52 of the second housing 54, which contains many. of the components and circuitry of the directable high intensity light beam of the lighting assembly 18, also referred to as the laser lighting assembly 18.

The second housing 54 is safely secured to the back 38 of a vertical, i.e. upright, load contacting member 32 which with others, also supports the horizontal forks 22. As these parts 54, 32, and 22, move up and down together there is sufficient clearance between them and the non moving vertical track structure 34 of the forklift 10, to prevent any damage to the second housing, as illustrated in viewing FIG. 3, 4, 5, 7, 10.

Figure 1:
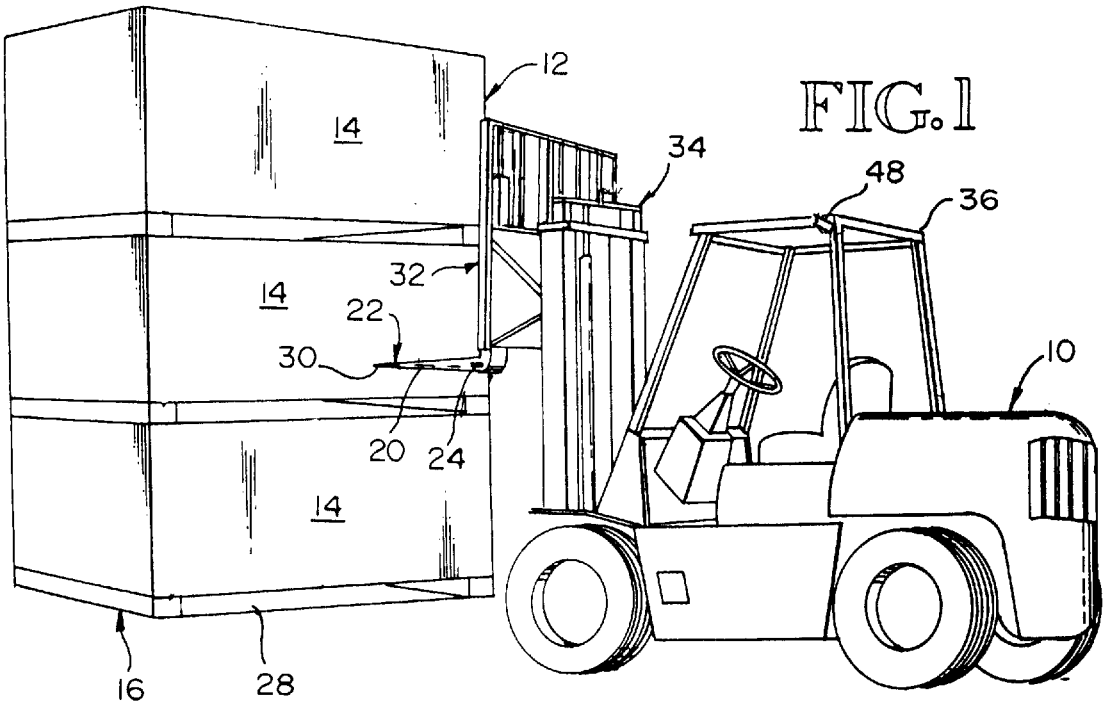
Figure 2:
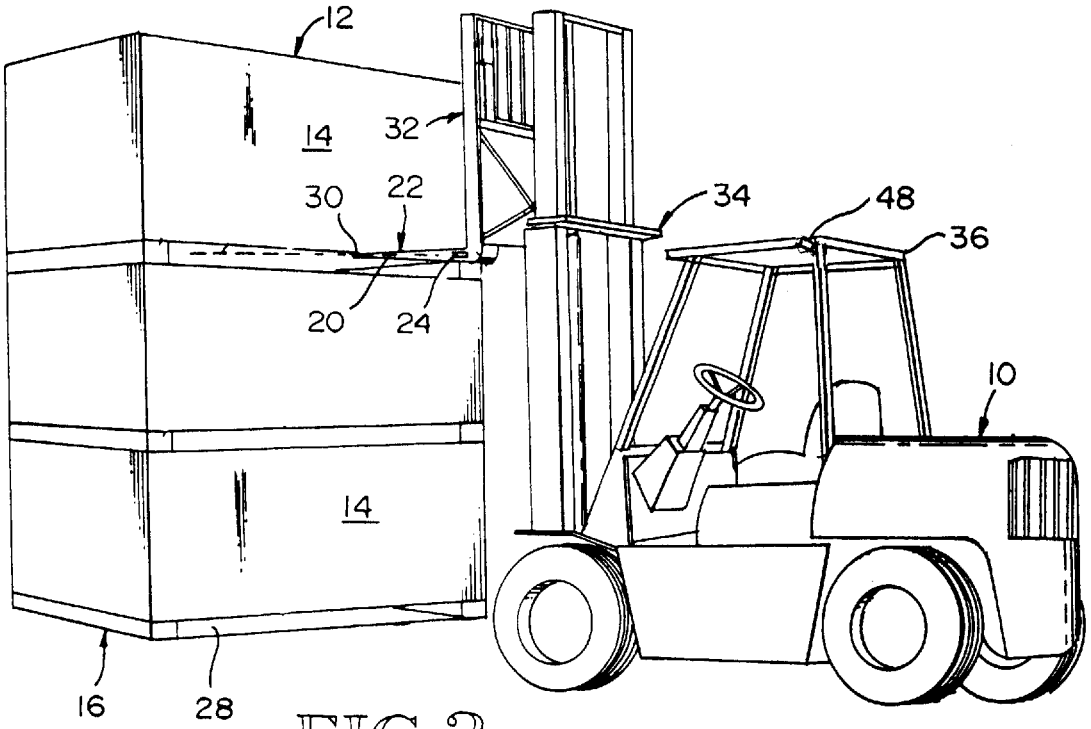

The second housing 54 is mounted at a selected height or the back 38 of the upright load contacting member 32, so when the forks 22 arrive at a pre-selected height, quite often set a seven feet above a floor or ground level, the infra-red receiving module 50, positioned in the second housing 54, will be high enough to receive the infra-red wave energy, and thereafter be active within the circuitry and system illustrated in FIGS. 15 and 16A. When active the infrared receiver module 50 transmits electrical energy to a micro-processor or controller 56, then its switching or distribution functions occur, so the laser light creating unit 24 is turned on. Thereafter, the operator of the forklift 10 is then able to observe reflections on loads, and the disappearances of reflections at the levels of the respective receiving volumes 28 of the respective pallets 16 arranged with respective loads 14 in a column arrangement 12, as illustrated in FIGS. 1, 2, and 3.

The Laser Light Creating Unit is Automatically Only Turned on when the Forks of a Forklift Have Been Adjusted to Be Extending Horizontally Parallel to a Floor or Ground Level Even though a tip 30 of a fork is adjusted to be at the proper level for its entry into the fork receiving volume 29 of a pallet 16, the operator must be assured that each fork 22 is also extending horizontally parallel to a floor or ground level. If a fork 22 entering the fork receiving volume is not sufficiently being near a level position, a pallet 16 and a load 14 thereon is tilted, and the load 14 may slide off the pallet causing damage to the load 14, and sometimes damages to other nearby loads 14.

Therefore, as illustrated in FIGS. 15, 16A and 16B, a tilt control circuit 60 is provided to enable the laser light creating unit 24 to receive electrical energy only when the forks 22 are extending horizontally parallel to a floor or ground level. As indicated in FIG. 15, the micro-processor controller 56, upon what is occurring in the tilt control circuit 60, is controlling whether or not electrical energy is being supplied, i.e. switched to the laser lighting assembly.

In FIG. 16B the schematic circuitry and electrical components are shown which comprise the tilt control circuit 60. There is the inclination sensor 62, and a level offset adjust unit 64 to adjust the range of the offset from a precise horizontal status of the forks 22. This offset range still insures that a pallet 16 and its load 14 will not be tilted to any degree that might cause the load 14 to slide off a pallet 10 and possibly cause damage to a product or products, and/or injure a person or persons.

In viewing FIGS. 16A and 16B, observe the laser line circuitry line representing cooperating functioning of the inclination sensor 62 and the micro-controller 56, which in FIG. 15 is called the micro-processor controller of logic of operations 56.

Preferably the Laser Light Creating Unit Preliminarily Blinks At Reducing Spaced Intervals when the Forks of a Forklift Are Being Adjusted to Be Extending Horizontally Parallel to a Floor or Ground Level When an operator of a forklift 10 is adjusting the forks 22 to be horizontally level enough, so when the forklift 10 is moved forward and the forks 22 enter the fork receiving volumes 28, there will not be any tilting of the pallet 16 and the load 14 thereon, preferably he or she will be observing a blinking reflection of the laser light beam 20. By judging the changing of the lengths of the intervals of the blinking reflection, he or she, will know well the forks 22 are being adjusted to reach the allowable offset range. As the intervals are being shortened, this allowable offset range is being approached. Then when the laser light reflection is observable full time, the positioning of the forks 22 is within the allowable offset range.

In FIG. 16B, the symbol used indicates how the inclination sensor 62 which is in the second housing 54 is utilized to provide this blinking of the laser light beam 20, creating the instructive reflections with their variable intervals. The operator of the forklift 10 when observing the changing lengths of the intervals is able to more quickly adjust the positions of the forks 22 to reach the allowable offset range.

When an Operator Has Left a Forklift, without Manually Switching Off the Electrical Power to the Laser Lighting Assembly, Preferably a No Movement Sensor Becomes Effective to Do So.

When an operator leaves a forklift 10 without manually switching off the electrical power to the laser lighting assembly 18, in order to conserve the source of electrical energy in a battery, a no motion sensing circuit 68 becomes effective to automatically switch off the electrical power to the laser lighting assembly 18, as illustrated in FIG. 15. The operation of this no motion sensing circuit 68 is particularly useful, when the electrical energy is being supplied by a small batters in the first housing 54, which contains most of the overall control circuitry and the controlling electrical components.

Figure 4:
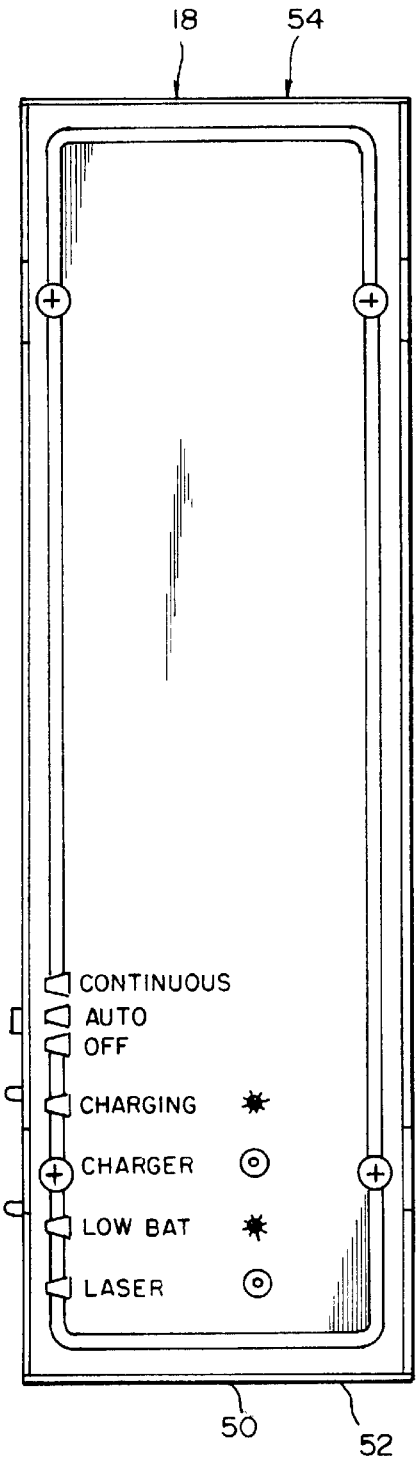
FIG. 4 is a side view of a second housing which contains many components, including circuitry, switches, and the infra-red receiving module, and as noted in FIG. 3, this second housing is secured on the backside of the upright, i.e. vertical, portions of a forklift that support the forks of the forklift.

The Operator of the Forklift, when the Forks Are Lowered Near Floor or Ground Level Conveniently Manually Changes a Three Position Switch Contained in the First Housing An operator of the forklift 10, when he or she lowers the forks 22 is able to position the second housing 54 within his or her convenient reach, as shown by observing FIGS. 3, 4, and 5. The three position switch 72 noted on FIG. 16A as the auto/continuous selector and by off, auto, and cont, has a finger contact portion 74 extending out from the side of the second housing 54, as shown in FIGS. 4 and 5.

The operator when commencing his or her use of the forklift 10 may select the automatic setting to get the full benefit of all the potential automatic changes of times when electrical power from a battery will or will not be reaching the laser lighting assembly 18. Then when she or he will be adjusting the forks below the selected level, which is generally seven feet above a floor or ground level, the continuous setting will be selected. Upon leaving the forklift 10 he or she will move the finger contact portion 74 to the off position of the three position switch. If he or she forgets, the no motion sensing circuit 68 will become effective and save the battery furnished electrical energy.

The Source of Electrical energy Via a Battery is Initially Selectable to Be by Removably Installing a Small Battery in the First Housing, or by Extending Circuitry to the Main Battery of a Forklift The second housing 54 illustrated in FIGS. 4, 5, 10 is larger and accommodates a removable battery. The third housing 76 illustrated in FIG. 12 is smaller for it does not accommodate a removable, battery. Instead, circuitry 78 is provided to extend to a main battery of a forklift which then provides the electrical energy needed when the laser lighting assembly 18 is turned on.

The Removable Installation of the Second Housing for Subsequent Service and Battery Charging When a second housing 54 is provided which is large enough to accommodate a small battery, the is second housing is positioned, by using a hook and loop fastener 78 secured on and in between the second housing 54 and a mounting bracket 80 which is preferably welded to the back 38 of one of the uprights, i.e. one of the vertical load contacting members 32, which together are supporting the forks 22.

On occasions this second housing 54, after being disconnected from the circuitry going to the laser light creating unit 24, will be conveniently removed by unfastening the hook and loop fasteners, and taken to a battery charger for a recharge. As noted in FIG. 4 on the second housing 54 containing many of the circuits and components of the laser lighting assembly 18, the indicia says continuous auto off, charging, changer, low bat, and laser. Then on the side of the second housing 54, as shown in FIG. 4, there is: the finger contact portion 74 of the three position switch 72; the green light 82 indicating charging; the socket 84 for receiving a charger circuit connector; the red light 86 indicating low battery; and the socket 88 for receiving a laser light creating unit circuit connector.

Utilization of a Laser Light Creating Unit which Creates a Laser Light Beam which Creates a Reflection on a Load that Appears As a Line When an operator of a forklift 10 is adjusting the overall positioning of the forks 22 so they are extending horizontally and are also, as a pair, in the same. horizontal plane, all before the forks are located at the level of fork receiving volume 28 of a pallet 16, preferably a laser light creating unit 24 mounted in a first housing 25 is installed on a fork 22, which creates a laser light beam 20 that produces a reflection 90 on a load 14, appearing as a line 90. For clarity of illustrating, the side of the load 14 is not shown on which the line reflection 90 is being observed, as illustrated in FIG. 11.

The Pre-Assembly of a Portion of a Conduit with a Smaller Fourth Housing, to Later Contain a Smaller Laser Light Creating Unit, the Housing Having Three Recesses for Later Adjusting Three Threaded Positioners of the Laser Light Creating Unit To speed up the installation of a laser lighting assembly 18 on a forklift 10, a pre-assembly 94 of a portion of a conduit 44 with a smaller fourth housing 96, is made by welding 98, as illustrated in FIG. 14. Then after clamping the pre-assembly 94 in place with clamps, not shown, the final welding 100 is undertaken.

Eventually, when all the conduit 44 is welded in place along the vertical load contacting members 32, part of the circuitry 40 with the smaller laser light creating unit 102 is passed down through the conduit 44. The balance of the circuitry 40, with some portions arranged as a coil, are extended with the end connector thereof to the second housing 54.

Then the smaller laser light creating unit 102 is fitted into the interior of the smaller fourth housing 96, through an entry, not shown.

A person installing the laser lighting assembly 18 continues on by moving the finger contact portion 74 of the three position switch 72 to the continuous position, and with the electrical energy available from a battery, the laser light beam 20 is produced. Thereafter, the installer aligns, as necessary, the laser light beam axis 106 to be inline with the extending fork 22.

He or she accomplishes the alignment by observing a reflection of the laser light beam, and then adjusting positioners, not shown, using a hand tool, not shown, alternately passed through a respective threaded recess 104 of two of them which are accessible after the preassembly 94 has been welded in place. The third positioner reached by a third threaded recess 104 has been previously adjusted before the pre-assembly 94 has been welded in place. When the reflection has been moved to a location which indicates the laser light beam axis 106 is in alignment with the extending fork 22, the installer knows that subsequently when the reflections on a load 14, disappear, the fork 22 will have been moved to the level of the fork receiving volume 28.

These Improvements to the Overall Laser Lighting Assembly Enhance the Ability of an Operator of a Forklift to Efficiently Move Loaded Pallets without Causing Any Fork Damage to Any Portions of a Load, and when Necessary Keeping the Laser Lighting Assembly Turned Off When an operator is actively moving a forklift 10 to accomplish the moving of loaded pallets 16, and he or she has been directed not to utilize the laser light beam 20 below a pre-selected level, generally selected as seven feet above floor level, he or she knows that if the three position switch 72 is in the automatic position, the laser light beam 20 will not come on below this level.

Also an operator will know, when the three position switch 72 is in the automatic position, the laser light beam 20 will not be turned on unless the forks 22 are extended horizontally to be parallel to a floor or ground level.

Then, if by chance, the operator leaves the forklift 10, without turning the three position switch 72 to the off position, instead leaving it in the automatic position, he or she understands, the no motion sensing circuit 68 becomes active to cut off the electrical energy through the circuitry 40 from a battery 58.

When a laser lighting assembly .18, is installed having a laser light creating unit 24 that projects a laser light beam 20, which upon reflection 90, as shown in FIG. 11, an operator, while observing the line reflection 90, is able to adjust the tips 30 of the forks 22 so the forks 22 will both be in the same horizontal plane, as the observed line reflection 90 is then in the same horizontal plane.

When the operator must lower the forks.22 below the pre-selected level, he or she does so until the three position switch 72 is reachable, and the finger contact portion 74 is moved, so the continuous position is reached. This change is preferably undertaken when the forklift 10 has been driven close enough to a location where a loaded pallet 16 is to be moved, so the possibility of a person walking by is very unlikely, who might be concerned by looking at the laser light beam 20, or being startled by it.

Once the lower level operations are concluded, the operator either returns the three position switch to the automatic position if higher level operations are to be undertaken, or returns the three position to the off position if the forklift is not to be used for lifting operations until a later period of time.

We claim:

1. A directable high intensity beam of light assembly, which is a laser light assembly, mountable on a forklift or a lifting and carrying equipment, so a beam of light, when turned on and projected forwardly, will always be parallel to and in the same horizontal plane of the forks of the forklift or the lifting and carrying equipments, which themselves, in respect to their respective lengths are both horizontal and parallel to a floor level or a ground level, and when the beam of light reaches a load on a pallet the reflections of the projected light beam will always be essentially observable by an operator of the lifting and carrying equipment or the forklift, until the reflections disappears, when the forks are moved to the level of a fork receiving volume of the pallet, and when the reflections disappear, the operator moves the forklift toward a loaded pallet and the forks enter the receiving volume of the pallet without any unwanted contact of the forks with any portion of the load, and without any unwanted tilting of the pallet which otherwise might cause the load to slidably tilt, thereby avoiding any possible damage to the load, which might otherwise occur when the movement of the forklift is undertaken with the forks improperly positioned comprising:

a) a first housing to receive some of components of said directable high intensity beam of light assembly, which is a laser light creating unit, is adaptable for securement to the fork of the lifting and carrying or the equipment or the forklift, so a beam of light projecting axis of the laser light assembly is arrangeable to be parallel to an extended axis of the fork or a projecting support;

b) the directable high intensity beam of light assembly, which is the laser light assembly, further comprising:

i) said laser light creating unit secured in the first housing;

ii) a circuitry for extending between the components of the laser light assembly;

iii) a second housing being adaptable to be secured to a vertical support directly supporting a horizontal portion of the fork, whereby the second housing internally positions portions of the circuitry, and other components of the laser light assembly;

iv) a manually operated switch positioned by the second housing and connected to the circuitry and moved to be in a selected position of three positions which are off, continuous, and automatic;

v) automatically operated switches positioned by the second housing and connected to the circuitry to respectively shut off electrical energy going to the laser light creating unit during respective operating times of the forklift when the manually operated switch is positioned in the automatic position, and vi) connectors to connect the circuitry to a source of the electrical energy.

2. The directable high intensity beam of light assembly, which is the laser light assembly, mountable on the forklift or lifting and carrying equipment, as claimed in claim 1, whereby to only have the electrical energy going to the laser light creating unit when the forks have arrived at a pre set elevation and have gone above this pre set elevation, an arrangement of infra-red wave energy components are included in the high intensity beam of light assembly, comprising:

a) an infra-red generator and emitter, having its own housing, a replaceable battery within its housing to supply the electric energy, Land in adjustable attaching means to position its housing on a selected high frame portion of the forklift, so the lowest elevation of the emitted infra-red wave energy will be received when the second housing has reached a specific locale above the floor or ground level during operations of the forklift;

b) an infra-red receiving module is positioned in the second housing, so when the second housing secured to the vertical support, supporting the horizontal portion of the fork, reaches the specific locale, when the pre set elevation of the forks has been reached if exceeded, the infra-red wave energy will be received to operate one of the automatic switches, to thereafter direct the electrical energy to the laser light creating unit, so the reflections of the laser light beam will be readily observed at the higher elevations of the forks, when the forks have not as yet reached a selected fork receiving volume of the pallet, yet when the selected fork receiving volume of the pallet is reached, the reflections of the laser light beam will no longer be observable by the operator and he or she may move the forklift forward to successfully lift the pallet without damaging the load, yet when the operator is raising and lowering the forks at the lower elevations, the laser light creating unit will not be receiving electrical energy, and therefore no reflections will be observable, nor will any person walking in the operational area be able to directly look into the laser beam of light thereby avoiding being startled or perceivably being concerned about directly looking into the laser beam of light.

3. The directable high intensity beam of light assembly, which is the laser light assembly mounted on the forklift or lifting and carrying equipment, as claimed in claim 1, whereby to only have the electrical energy going to the laser light creating unit when the forks are parallel to the floor level or ground level, one of the automatically operated switches positioned by the second housing and connected to the circuitry includes a level sensing component which senses whether or not the forks are parallel to the floor level or the ground level, and when the forks are so level, the automatically operated switch closes and the electrically energy is directed to the laser light creating unit.

4. The directable high intensity beam of light assembly, which is the laser light assembly mountable on the forklift or lifting and carrying equipment, as claimed in claim 3 whereby, to assist the operator of the forklift in adjusting the forks to be parallel to the floor level or the ground level, the automatically operated switch and the associated circuitry include an means used to commence the blinking of the laser light beam, first having long intervals between blinks, and then shortening the intervals between blinks until the forks become parallel to the floor or ground level, when the electrical energy is automatically fully switched through the automatically operated switch to reach the laser light creating unit, thereby providing a constant laser light beam directable upon maneuvering the forklift toward the loaded pallet, where the reflections of the laser light beam are observable on the load, and the reflections are not observable, when the laser light beam enters the fork receiving volume of the pallet.

5. The directable high intensity beam of light assembly, which is laser light assembly mountable on the forklift or lifting and carrying equipment, as claimed in claim 2, whereby to only have the electrical energy going to the laser light creating unit when the forks are parallel to the floor level or the ground level, one of the automatically operated switches positioned by the second housing and connected to the circuitry includes a level sensing component which senses whether or not the forks are parallel to the floor level or the ground level, and when the forks are so level, the automatically operated switch closes and electrically energy is directed to the laser light creating unit.

6. The directable high intensity beam of light assembly, which is the laser light assembly mountable on the forklift or lifting and carrying equipment, as claimed in claim 5, whereby to assist the operator of the forklift in adjusting the forks to be parallel to the floor level or the ground level, the automatically operated switch and the associated circuitry include a means used to commence the blinking of the laser light beam, first having long intervals between blinks, and then shortening the intervals between blinks until the forks become parallel to the floor level or ground level, when the electrical energy is automatically fully switched through the automatically operated switch to reach the laser light creating unit, thereby providing a constant laser light beam directable upon maneuvering the forklift toward loaded pallets, where the reflections of the laser light beam are observable on the load, and the reflections are not observable, when the laser light beam enters the fork receiving volume of the pallet.

7. The directable high intensity beam of light assembly, which is the laser light assembly, mountable on the forklift or lifting and carrying equipment, as claimed in claim 1, whereby to only have the electrical energy going to the laser light creating unit when the forklift is being operated, a means is provided to detect when the forklift has not moved for a preset time period, and then one of the automatically operated switches is opened to stop the flow of the electrical energy to the laser light creating unit, until the operator again moves the forklift and this switch is automatically closed again.

8. The directable high intensity beam of first assembly, which is the laser light assembly, mountable on the forklift or lifting and carrying equipment, as claimed in claim 2, whereby to only have the electrical energy going to the laser light creating unit when the forklift is being operated, a means in provided to detect when the forklift has not moved for a pre-set time period, and then one of the automatically operated switches is opened to stop the flow of electrical energy to the laser light creating unit, until the operator again moves the forklift and this switch is automatically closed again.

9. The directable high intensity beam of first assembly, which is the laser light assembly, mountable on the forklift or lifting and carrying equipment, as claimed in claim 3, whereby to only have the electrical energy going to the laser light creating unit when the forklift is being operated, a means in provided to detect when the forklift has not moved for a pre-set time period, and then one of the automatically operated switches is opened to stop the flow of the electrical energy to the laser light creating unit, until the operator again moves the forklift and this switch is automatically closed again.

10. The directable high intensity beam of first assembly, which is the laser light assembly, mountable on the forklift or lifting and carrying equipment, as claimed in claim 4, whereby to only have the electrical energy going to the laser light creating unit when the forklift is being operated, a means in provided to detect when the forklift has not moved for a pre-set time period, and then one of the automatically operated switches is opened to stop the flow of the electrical energy to the laser light creating unit, until the operator again moves the forklift and this switch is automatically closed again.

11. The directable high intensity beam of light assembly which is the laser light assembly, mountable on the forklift or lifting and carrying equipment, as claimed in claim 1, comprising in addition the source of the electrical energy which is a battery.

12. The directable high intensity beam of light assembly, which is the laser light assembly, mountable on the forklift or lifting and carrying equipment, as claimed in claim 2, comprising in addition the source of the electrical energy which is a battery.

13. The directable high intensity beam of light assembly, which is the laser light assembly, mountable on the forklift or lifting and carrying equipment, as claimed in claim 3, comprising in addition the source of the electrical energy which is a battery.

14. The directable high intensity beam of light assembly, which is the laser light assembly, mountable on the forklift or lifting and carrying equipment, as claimed in claim 4, comprising in addition the source of the electrical energy which is a battery.

15. The directable high intensity beam of light assembly, which si the laser light assembly, mountable on the forklift or lifting and carrying equipment, as claimed in claim 7, comprising in addition the source of electrical energy which is a battery.

16. The directable high intensity beam of light assembly, which is the laser light assembly, mountable on the forklift or lighting and carrying equipment, as claimed in claim 1, 2, 3, or 4, wherein the laser light creating unit creates a laser light beam which upon reflection appears as a line, and then the line reflection is observed by the operator of the forklift to adjust the positions of the forks, so the forks are in the same horizontal plane, which plane is parallel to the floor or ground level, over which level the forklift is to be driven toward the loaded pallet.

17. A laser light assembly, mountable on a forklift, so a beam of laser light thereof, when turned on and projected forwardly, will always be parallel to and in the same horizontal plane of forks of which forklift , which themselves, in respect to their respective lengths are both horizontal and parallel to a floor level or a ground level, and when the beam of laser light reaches a load on a pallet the reflection of the projection laser light beam will always be essentially observable by an operator of the forklift, until the reflection, upon movement of the forks, disappears, when the forks are moved to the level of a fork receiving volume of the pallet, and when the reflection disappears, the operator moves the forklift toward a loaded pallet and the forks enter the receiving volume of the pallet without any unwanted contact of the forks with any portion of the load, and without any unwanted tilting of the pallet which otherwise might cause the load to slidably tilt, thereby avoiding any possible damage to the load, which might otherwise occur when the movement of the forklift is undertaken with the forks improperly positioned comprising:

a) a first housing to receive some of components of the laser light assembly, inclusive of a laser light creating unit thereof, is adaptable for securement to the fork of the forklift, so a beam of laser light projecting axis is arrangeable to be parallel to an extended axis of the fork of the forklift;

b) the laser light assembly, further comprising:

i) the laser light creating unit secured in the first housing;

ii) a circuitry for extending between the components of the laser light assembly, iii) a second housing being adaptable to be secured to a vertical support directly supporting a horizontal portion of the fork of the forklift, whereby the second housing internally positions portions of the circuitry, and other components of the laser light assembly;

iv) a manually operated switch positioned by the second housing and connected to the circuitry and moved to be in a selected position of three positions which are off, continuous, and automatic;

v) automatically operated switches positioned by the second housing and connected to the circuitry to respectively shut off electrical energy going to the laser light creating unit of the laser light assembly during respective operating times of the forklift when the manually operated switch is positioned in the automatic position; and vi) connectors to connect the circuitry to a source of the electrical energy.

18. The laser light assembly, as claimed in claim 17, whereby to only have the electrical energy going to the laser light creating unit when the forks have arrived at a pre set elevation and have gone above this pre set elevation, an arrangement of infra-red wave energy components are included in the light assembly, comprising:

a) an infra-red wave generator and emitter, having its own housing, a replaceable battery-within its housing to supply the electrical energy, and an adjustable attaching means adaptable to position its own housing on a selected high frame portion of the forklift, so the lowest elevation of the emitted infra-red wave energy will be received when the second housing has reached a specific locale above the floor or ground level during operations of the forklift;

b) an infra-red wave receiving module is positioned in the second housing, so when the second housing secured to the vertical support, supporting the horizontal portion of the fork, reaches the specific locale, when the pre set elevation of the forks has been reached or exceeded, the infra-red wave energy will be received to operate one of the automatic switches, to thereafter directs the electrical energy to the laser light creating unit, so the reflections of the laser light beam will be readily observed on the load at the higher elevations of the forks, when the forks have not as yet reached a selected fork receiving volume of the pallet supporting the load, yet when the selected fork receiving volume of the pallet is reached, the reflections of the laser light beam will no longer be observable by the operator and he or she may move the forklift forward to successfully lift the pallet without damaging the load, yet when the operator is raising and lowering the forks at the lower elevations, the laser light creating unit will not be receiving the electrical energy, and therefore no reflections will be observable, nor will any person walking. in the operational area be able to directly look into the laser beam of light thereby avoiding being startled or perceivably being concerned about directly looking into the laser beam of light.

19. The laser light assembly, as claimed in claim 18, whereby to only have the electrical energy going to the laser light creating unit when the forks are parallel to the floor level or ground level, one of the automatically operated switches positioned by the second housing and connected to the circuitry includes a level sensing component which senses whether or not the forks are parallel to the floor level or a ground level, and when the forks are so level, the automatically operated switch closes and the electrically energy is directed to the laser light creating unit.

20. The laser light assembly, as claimed in claim 19 whereby, to assist the operator of the forklift in adjusting the forks to be parallel to the floor level or the ground level, the automatically operated switch and the associated circuitry include a means used to commence the blinking of the laser light beam, first having long intervals between blinks, and then shortening the intervals between blinks, until the forks become parallel to the floor or ground level, when the electrical energy is automatically fully switched through the automatically operated switch to reach the laser light creating unit, thereby providing a constant laser light beam directable upon maneuvering the forklift toward loaded pallet, where the reflection of the laser light beam is observable on the load, and the reflection is not observable, when the laser light beam enters the fork receiving volume of the pallet.

21. The laser light assembly, as claimed in claim 20, whereby to only have the electrical energy going to the laser light creating unit when the forklift is being operated, a means is provided to detect when the forklift has not moved for a preset time period, and then one of the automatically operated switches is opened to stop the flow of the electrical energy to the laser light creating unit, until the operator again moves the forklift and this switch is automatically closed again.

22. The laser light assembly, as claimed in claim 21, wherein the laser light creating unit creates a laser light beam which upon reflection appears as a line, and then the line reflection is observed by the operator of the forklift to adjust the positions of the forks, so the forks are in the same horizontal plane, which plane is parallel to the floor or ground level, over which level the forklift is to be driven toward the pallet.

23. The laser light assembly, as claimed in claim 22, comprising in addition the source of electrical energy which is a battery, and utilizing the connectors to connect the circuitry to this battery.

24. The laser light assembly, as claimed in claim 23, wherein the battery is positioned in the second housing and is connected to the circuitry therein.

25. The laser light assembly, as claimed in claim 23, wherein the battery utilized is a battery of the forklift.

* * * * *